US009923270B1

(12) United States Patent
Little et al.

(10) Patent No.: US 9,923,270 B1
(45) Date of Patent: Mar. 20, 2018

(54) BEAMSTEERING TECHNIQUE TO MINIMIZE SIDELOBES DUE TO PHASE QUANTIZATION IN A PHASED ARRAY ANTENNA

(71) Applicant: Raytheon Company, Waltham, MA (US)

(72) Inventors: Matthew P. Little, Harvard, MA (US); Landon L. Rowland, Westford, MA (US); Douglas M. McKay, Nashua, NH (US)

(73) Assignee: Raytheon Company, Waltham, MA (US)

( * ) Notice: Subject to any disclaimer, the term of this patent is extended or adjusted under 35 U.S.C. 154(b) by 651 days.

(21) Appl. No.: 14/563,638

(22) Filed: Dec. 8, 2014

Related U.S. Application Data

(63) Continuation of application No. 14/482,479, filed on Sep. 10, 2014, now abandoned.

(51) Int. Cl.
*H01Q 3/00* (2006.01)
*H01Q 3/34* (2006.01)

(52) U.S. Cl.
CPC ..... *H01Q 3/34* (2013.01)

(58) Field of Classification Search
CPC ..... H01Q 3/00; H01Q 3/34; G01S 19/36
USPC ..... 342/371, 357.76
See application file for complete search history.

(56) References Cited

U.S. PATENT DOCUMENTS

| | | | | |
|---|---|---|---|---|
| 4,188,633 | A | 2/1980 | Frazita | |
| 5,103,232 | A | 4/1992 | Chang et al. | |
| 9,379,436 | B1 * | 6/2016 | Yu | H01Q 3/267 |
| 2003/0086508 | A1 * | 5/2003 | Magee | H04L 27/0014 375/340 |
| 2009/0142076 | A1 * | 6/2009 | Li | H04B 10/61 398/208 |

OTHER PUBLICATIONS

Holm, Sep. 1992, IEEE, 0885-3010/092503.00, pp. 1-7.*
C.J. Miller, "Minimizing the Effects of Phase Quantization Errors in an Electronically Scanner Array", Proceedings of Symposium on Electronically Scanned Array Techniques and Applications, Technical Documentary Report No. RADC-TDR-64-225, vol. 1, Jul. 1964, pp. 17-38.
Smith et al. "A Comparison of Methods for Randomizing Phase Quantization Errors in Phased Arrays", IEEE Transactions on Antennas and Propagation, vol. AP-31 , No. 6, Nov. 1983.

* cited by examiner

*Primary Examiner* — Harry K Liu
(74) *Attorney, Agent, or Firm* — Burns & Levinson, LLP; Joseph M. Maraia

(57) ABSTRACT

The Active Electronically Scanned Lens Array design for a phased array reduces the cost of the phased array with minimal sacrifice to array performance. The design replaces transmit/receive (T/R) modules at the front end of the array with low cost and low lost phase shifters. A tradeoff in this design is a periodic phase quantization error that leads to quantization lobes. To reduce quantization lobes, a phase addition approach is presented to break up with the periodicity. In the presented approach, a phase offset is added at a T/R module and then corrected for at each radiating element in the array. The applied phase offset can be either deterministic or random.

14 Claims, 5 Drawing Sheets

BEAMSTEERING TECHNIQUE TO MINIMIZE SIDELOBES DUE TO PHASE QUANTIZATION IN A PHASED ARRAY ANTENNA

RELATED APPLICATIONS

This application is a continuation of U.S. application Ser. No. 14/482,479 filed Sep. 10, 2014 entitled "BEAMSTEERING TECHNIQUE TO MINIMIZE SIDELOBES DUE TO PHASE QUANTIZATION IN A PHASED ARRAY ANTENNA." The entire teachings of the above application is incorporated herein by reference for all purposes.

BACKGROUND

Phased array antennas, comprised of many individual radiating elements, require precise control of the phase of the signals driving the elements. This phase control provides a means to electronically steer the antenna beam and obtain a desirable antenna pattern. The phase control is typically provided by digitally controlled phase shifters with a finite number of phase state settings. It is desirable to minimize the number of states and complexity of the phase shifters for low cost. However, the lower the number of states, the more likely the antenna pattern will have undesirable sidelobe levels due to the quantization errors that result from the error between the desired and realized phase settings. These sidelobes, called "quantization lobes" cause interoperability and performance limitations in modern phased array antennas used for communication or radar systems.

SUMMARY

In accordance with an example, a method for reducing sidelobes due to phase quantization in a phased array antenna is provided. The method includes, in a phased array antenna having a plurality of radiating elements, modifying a radiofrequency signal having a phase resulting in a modified signal. The method further includes adding a phase offset to the modified signal. The method further includes splitting the modified signal with the added phase offset into a plurality of signal portions. The method further includes adding a phase having a bias to each one of the plurality of signal portions, such that an average of the biases being added is the inverse of the phase offset added to the modified signal. The method further includes providing a respective signal portion with added phase with bias to each of the plurality of radiating elements. The signal portions radiated by the plurality of radiating elements represent, collectively, a beam steered by the phased array antenna with reduced sidelobes.

In accordance with another example, a system for reducing sidelobes due to phase quantization in a phased array antenna is provided. The system includes a phased array antenna comprising a plurality of radiating elements, a plurality of element level phase shifters, each communicatively coupled to a radiating element, a front-end beamformer communicatively coupled to the plurality of element level phase shifters, and a transmit/receive (T/R) module communicatively coupled to the front-end beamformer. The front-end beamformer is configured to receive a modified signal and to split the modified signal into the plurality of signal portions. The system further includes a beamsteering controller communicatively coupled to the phased array antenna. The beamsteering controller is configured to command the T/R module to modify a radiofrequency signal having a phase resulting in the modified signal. The beamsteering controller is further configured to command each of the plurality of element level phase shifters to add a respective phase having a bias to one of the plurality of signal portions, such that an average of the biases being added is the inverse of the phase offset added to the modified signal, and to provide a respective signal portion to one of the plurality of radiating elements, such that signal portions radiated by the plurality of radiating elements represent, collectively, a beam steered by the phased array antenna with reduced sidelobes.

In accordance with yet another example, a tangible computer-readable storage medium having computer readable instructions stored therein for reducing sidelobes due to phase quantization in a phased array antenna is provided. The computer readable instructions when executed by a beamsteering controller cause the beamsteering controller to command a T/R module to modify a radiofrequency signal having a phase resulting in a modified signal including a periodic error in the phase, and to add a phase offset to the modified signal. The modified signal is split into a plurality of signal portions by a front-end beamformer. The beamsteering controller is further caused to command each of the plurality of element level phase shifters to add a respective phase having a bias to one of the plurality of signal portions, such that an average of the biases being added is the inverse of the phase offset added to the modified signal, and to provide a respective signal portion to one of a plurality of radiating elements, such that signal portions radiated by the plurality of radiating elements represent, collectively, a beam steered by the phased array antenna with reduced sidelobes.

In some examples, any of the aspects above can include one or more of the following features.

In other examples, the phased array antenna includes a transmit/receive (T/R) module coupled to each subarray of radiating elements grouped from the plurality of radiating elements, the T/R module includes a T/R module phase shifter, and each radiating element is associated with an element level phase shifter. In these examples, adding the phase offset includes directing the T/R module phase shifter to add the phase offset to the modified signal, and adding the phase having the bias includes directing the element level phase shifter to add the phase with bias to respective signal portions.

In some examples, the T/R module phase shifter is a 7-bit phase shifter and each element level phase shifter is a 3-bit phase shifter.

In other examples, the T/R module further includes an attenuator.

In some examples of the method, adding the phase offset to the modified signal includes selecting the phase offset from a random distribution of phase offsets with a mean value of zero.

In other examples of the method, adding the phase offset to the modified signal includes selecting the phase offset from a distribution of phase offsets that is spherical in shape, and having a zero phase offset at the center of the distribution and increasing phase offsets towards the periphery of the distribution.

In some examples of the method, adding the phase offset includes applying a zero phase offset at the center of the phased array antenna.

In other examples of the method, adding the phase offset includes applying a maximum phase offset at the edge of the phased array antenna.

In one example, the method further includes selecting a magnitude of the phase offset being added to the modified signal based on a scan angle location of the phased array antenna.

In some examples of the system, the T/R module phase shifter is a 7-bit phase shifter and each element level phase shifter is a 3-bit phase shifter.

In other examples of the system, the phase offset added to the modified signal is selected from a random distribution of phase offsets with a mean value of zero.

In some examples of the system, the offset added to the modified signal is selected from a distribution of phase offsets that is spherical in shape, and having a zero phase offset at the center of the distribution and increasing phase offsets towards the periphery of the distribution.

In other examples of the system, a zero phase offset from the distribution is applied at the center of the phased array antenna.

These and other features and characteristics, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of claims. As used in the specification and in the claims, the singular form of "a", "an", and "the" include plural referents unless the context clearly dictates otherwise.

BRIEF DESCRIPTION OF THE DRAWINGS

The foregoing and other objects, features and advantages will be apparent from the following more particular description of the examples, as illustrated in the accompanying drawings in which like reference characters refer to the same parts throughout the different views. The drawings are not necessarily to scale, emphasis instead being placed upon illustrating the principles of the examples.

DETAILED DESCRIPTION

Figure 1:
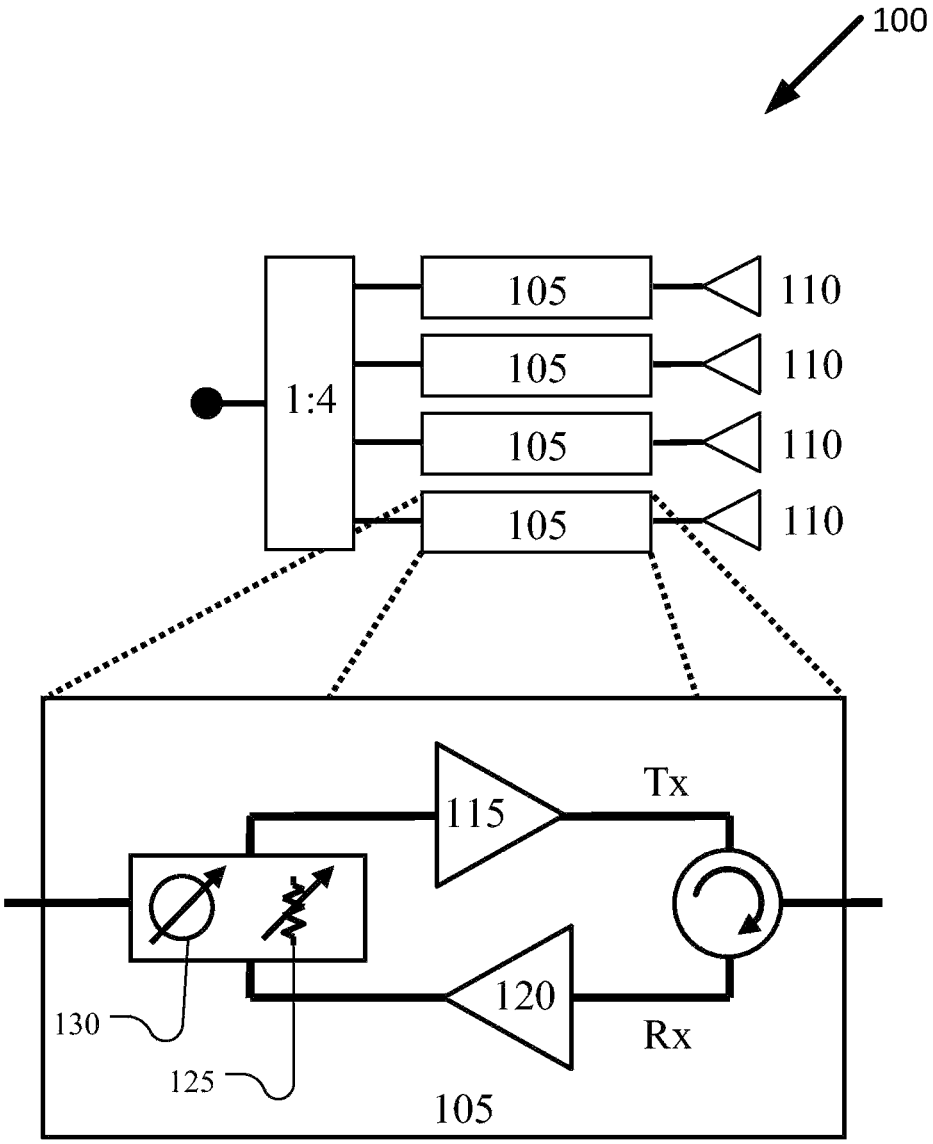
FIG. 1 (Prior Art)
FIG. 1 is a block diagram of the front end architecture of a typical Active Electronically Scanned Array antenna.

In the description that follows, like components have been given the same reference numerals, regardless of whether they are shown in different examples. To illustrate an example(s) of the present disclosure in a clear and concise manner, the drawings may not necessarily be to scale and certain features may be shown in somewhat schematic form. Features that are described and/or illustrated with respect to one example may be used in the same way or in a similar way in one or more other examples and/or in combination with or instead of the features of the other examples.

FIG. 1 shows the front end architecture of a typical Active Electronically Scanned Array (AESA) antenna 100. The AESA antenna 100 includes transmit/receive (T/R) modules 105 coupled to radiating elements 110 in a one-to-one arrangement. The T/R modules 105 contain the control mechanisms to provide the required amplitude and phase excitation at each radiating element 110 to steer the main beam and control the shape of the antenna pattern. The key radio frequency (RF) components of each of the T/R modules 105 are a power amplifier (PA) 115 for transmit mode, a low noise amplifier (LNA) 120 for receive mode, an attenuator 125 for amplitude control, and a phase shifter 130 for phase control. The phase shifter 130 is typically a monolithic microwave integrated circuit (MMIC) device with as many as seven bits of phase control, giving phase control steps of 2.8125°.

In existing AESA antenna designs, one T/R module 105 is used for each radiating element 110 in the array, meaning the number of T/R modules 105 is equal to the number of radiating elements 110 in the array. (As shown, there are four T/R modules for four radiating elements.) Because of their complexity and high quantity required, the T/R modules 105 represent a significant portion of the overall cost of the array 100. Accordingly, there is a desire to reduce the number of T/R modules to produce more affordable arrays.

In an Active Electronically Scanned Lens Array (AESLA) antenna, instead of a high cost T/R module, a low cost, low loss element level phase shifter is associated with each radiating element. This configuration reduces array cost with minimal sacrifice to array performance. The element level phase shifters are grouped together forming an active lens. A typical AESLA has many active lenses. Each active lens is associated with a T/R module that provides amplitude control and an additional level of phase control for that active lens. This reduces the number of T/R modules needed in the array while preserving phase control at each radiating element.

An important factor in radar and communication design is the component(s) at the front end. In current AESA antennas, with reference to the T/R module 105 of FIG. 1, the LNA 120 is at the front end of the receive path to provide gain and a low noise figure to received signals. The PA 115 is at the front end of the transmit path to provide gain to transmitted signals. In AESLA antennas, an element level phase shifter in the active lens replaces both of the LNA and PA as the front end components for both receive and transmit modes. For acceptable performance, it is beneficial that the element level phase shifter are low loss to keep the receive noise figure low and not to add excess loss to the receive and transmit paths. To achieve low loss in an element level phase shifter, a low number of bits of phase control (e.g., three) are used which in turn reduces phase control. The consequence of reduced phase control is phase quantization that is periodic across the array. The periodic quantization (or periodic phase error) causes high peak sidelobes called quantization lobes.

To reduce quantization lobes (transmit and/or receive sidelobes) and to improve interoperability and performance of phased array antennas used in communication and radar systems, a phase addition approach is presented. As an overview, the phase addition approach adds a phase offset(s) to an array/subarray and corrects for the added phase offset(s) at each radiating element in the array/subarray. This breaks up the periodicity of a phase error and reduces quantization 1.

Figure 2:
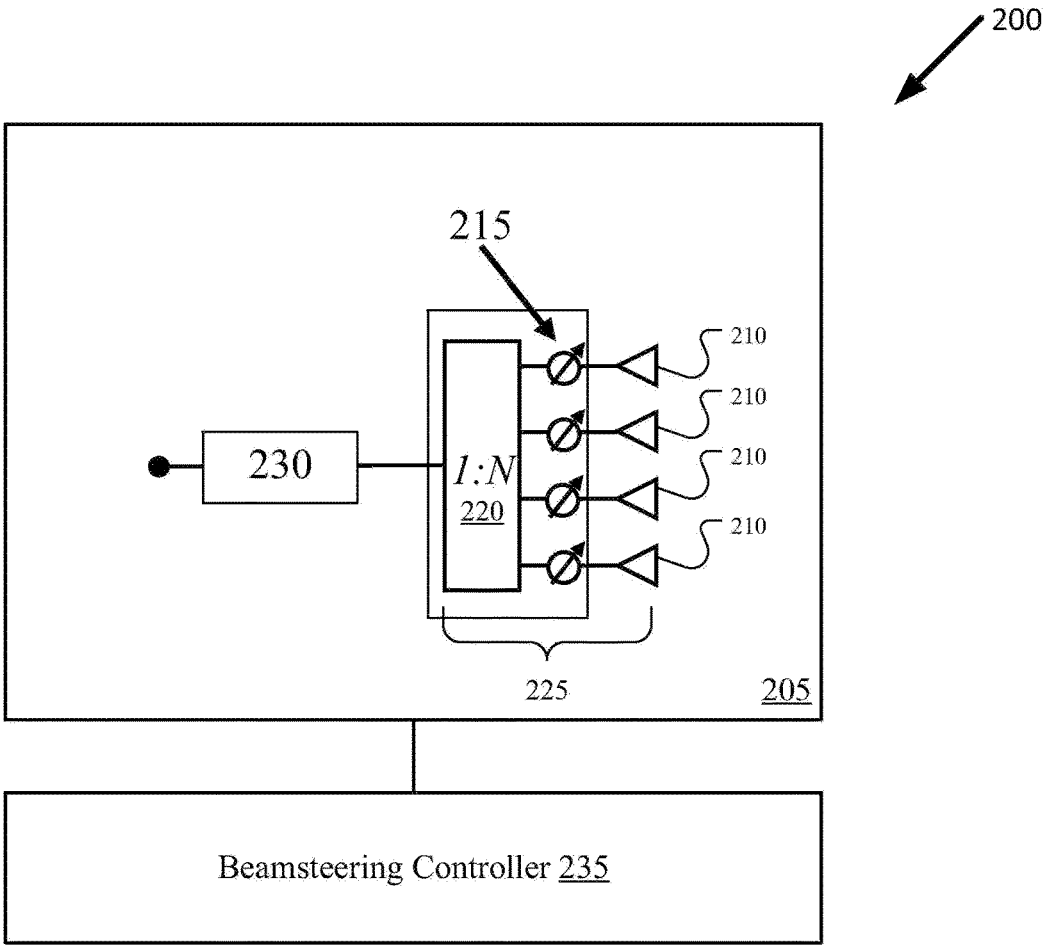
FIG. 2 is a block diagram of an example system for reducing sidelobes due to phase quantization in a phased array antenna using a phase addition approach of the present disclosure.

FIG. 2 shows an example system 200 for reducing quantization lobes using the phase addition approach. The system 200 includes an antenna 205 (e.g., radar or communication antenna) including a plurality of radiating elements 210 (four of which are shown but in some examples there are 10's, 100's, or 1000's of radiating elements). The antenna 205 further includes a plurality of element level phase shifter 215, a front-end beamformer 220, and a T/R module 230 each communicatively coupled to each other as shown. An array beamformer (not shown) coupled to the T/R module 230 provides radio frequency (RF) signals (e.g., radar or communication signals) to the radiating elements 210 and provides RF signals acquired by the antenna 205.

The T/R module 230 controls the amplitude of an RF signal. The T/R module 230 further controls the phase of the RF signal by way of a phase shifter (not shown). The front-end beamformer 220 then distributes the RF signal from the T/R module 230 to the plurality of element level phase shifters 215 (also referred to as "front-end phase shifters"). The element level phase shifters 215, in turn, control the relative phases of the distributed RF signals provided to the radiating elements 210 (e.g., in accordance with the procedure of FIG. 3 described below). The element level phase shifters 215 are low cost, low loss components.

The front-end beamformer 220 includes an N-way power combiner/splitter grouping the element level phase shifters 215 into an active lens 225 (one of which is shown but in some examples there are 10's, 100's of active lens). The T/R module 230 provides amplitude control and another level of phase control for the active lens 225. This arrangement reduces the number of T/R modules needed in the array by a factor of N while preserving phase control at each radiating element 210.

The phase addition approach takes advantage of the two levels of phase control present in the AESLA design. The system 200 includes an beamsteering controller 235 communicatively coupled to the antenna 205. The beamsteering controller 235 commands the element level phase shifters 215 and the T/R module 230, e.g., by sending commands. For a given active lens in the antenna 205, the beamsteering controller 235 adds a phase offset to the T/R module phase shifter corresponding to the active lens. The applied phase offset can be either deterministic, like a phase taper, or random (both described below in greater detail). The beamsteering controller 235 corrects for the phase offset in the element level phase shifters 215 within the active lens. Because the amount of phase offset is different between adjacent lenses, the correction needed at the radiating elements 210 varies from lens to lens. This in turn breaks up the periodicity of the phase error and reduces quantization sidelobes.

Figure 3:
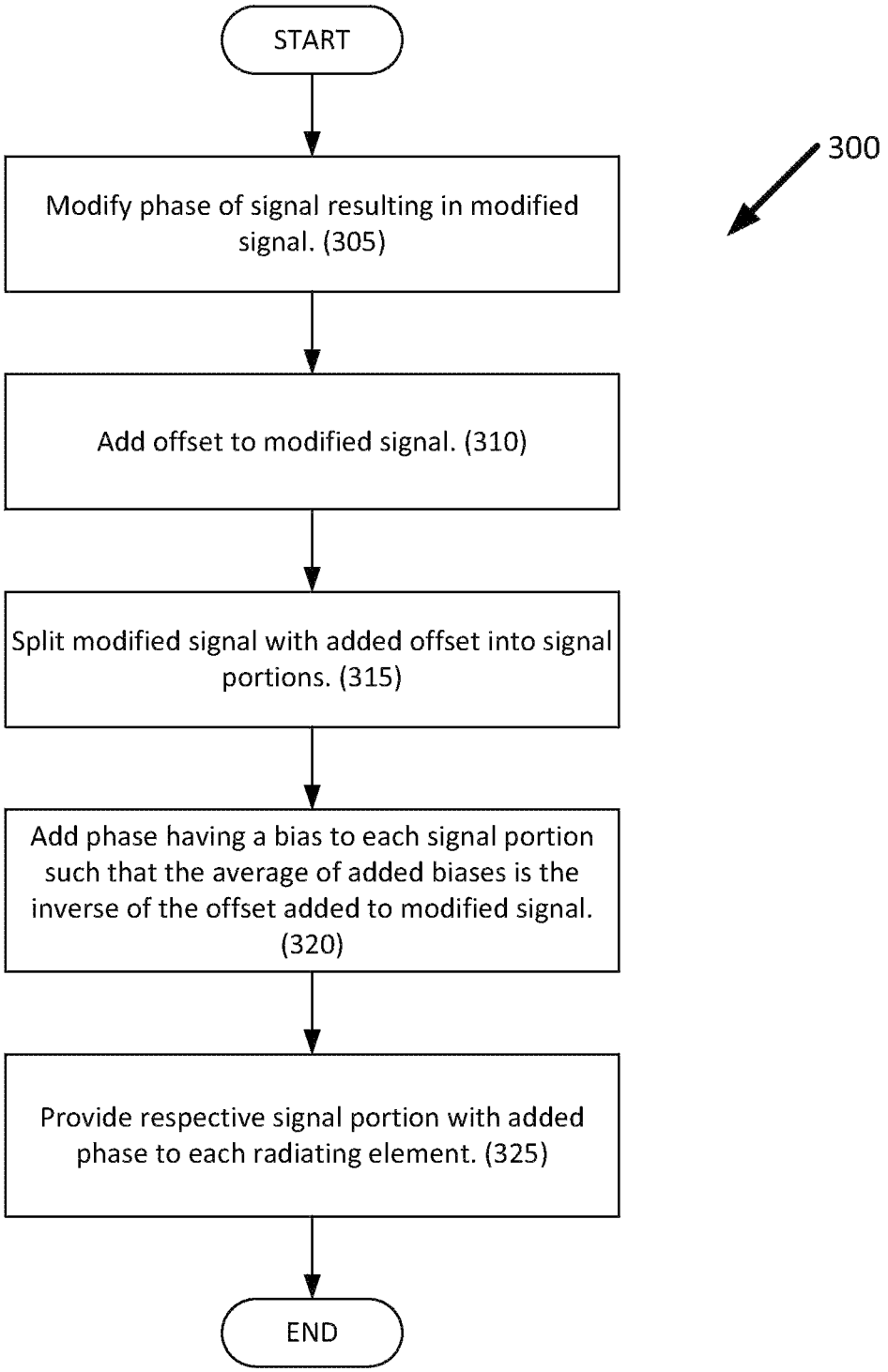
FIG. 3 is a flowchart of an example procedure for reducing quantization lobes using the disclosed phase addition approach.

FIG. 3 shows (with reference to FIG. 2) an example procedure 300 of the phase addition approach for reducing quantization lobes. The procedure 300 is implemented, for example, by the beamsteering controller 235 of FIG. 2. For ease of discussion, the procedure 300 is described with reference to a single array of radiating elements. In practice, however, the radiating elements are arranged into active lenses or "subarrays," as described above with reference FIG. 2, and the procedure 300 is performed at each subarray. For example, in a phased array antenna with 16 subarrays, 16 instances of the procedure 300 are performed.

The beamsteering controller 235 sends commands to phase shifters to modify (305) the phase and amplitude of a signal in the array to change the directionality of the array. The modification of amplitude and phase creates a pattern of constructive and destructive interference that maximizes the signal transmitted or received in a specific direction and minimizes the signal transmitted or received in other directions. This process is called beamforming. Because of limitations of the array, errors exist in the amplitude and phase accuracy of the beamforming process.

The beamsteering controller 235 commands the T/R module 230 to add (310) a phase offset to the signal. This modifies the periodicity of the phase error that results from beamforming. The front-end beamformer 220 splits (315) the signal among each of the individual radiating elements within the array.

At each radiating element, the beamsteering controller 235 commands each element level phase shifter 215 to add (320) a proper phase to create a pattern of constructive and destructive interference that maximizes the signal transmitted or received in a specific direction and minimizes the signal transmitted or received in other directions. Additionally, the beamsteering controller 235 commands each element level each element level phase shifter 215 to add a constant phase, equal to the inverse of the offset phase added in step 310, to the radiating elements. In more detail, at each radiating element, the element level phase shifters 215 add a bias such that the average of the biases being added is equal to the inverse of the offset phase added in step 310. This corrects the phase error introduced during beamforming and modifies the periodicity of the phase error, which would have otherwise increase the signal for undesired transmit or receive directions.

The element level phase shifters 215 provide (325) the resulting signal to the radiating elements. The signal sent matches the hardware impedance to that of free space enabling efficient radiation of the array into the environment. The foregoing explanation describes the process for transmit operation of the antenna 205. The receive process operates identically, however, the signal is input into the radiating elements 210 on receive and travels in the reverse direction as described, following similar steps.

One advantage of the phase addition approach is that it requires fewer changes to the array design, which simplifies manufacturing and lowers cost. Another advantage of the phase addition approach is that the reduction of quantization sidelobes can be reconfigured during operation to give the best performance at all scan locations based on given specifications. For example, during operation, a first phase offset to add to a first modified signal is selected and a second phase offset, different from the first phase offset, to add to a second modified signal is then selected based on scan locations of the first modified signal and the second modified signal, respectively. This enables the phased array to optimize the amount of phase offset to apply to achieve the lowest possible sidelobe level when the array scans to different angles, which produces the best possible performance for a given array configuration.

Other approaches to breaking up phase error periodicity have been proposed. One hardware implementation is to add different lengths of cable to the beamforming network and have the element level phase shifters correct for the resulting phase delay. These lengths can be either random or lengths that simulate a spherical space feed to the aperture. Another approach to reducing phase periodicity is to randomly offset the physical location of the radiating elements. Although these hardware implementations can reduce quantization sidelobes, they are undesirable because they add complexity to the array design, which in turn increase cost, and they are not reconfigurable during radar operation, which in turn limit operational performance.

Figure 4A:
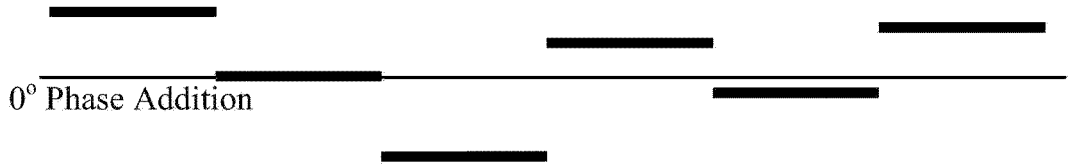
FIG. 4A-C are diagrams of adding random phase offsets at the beamforming level and correcting for the added offsets at the element level.
Figure 4B:
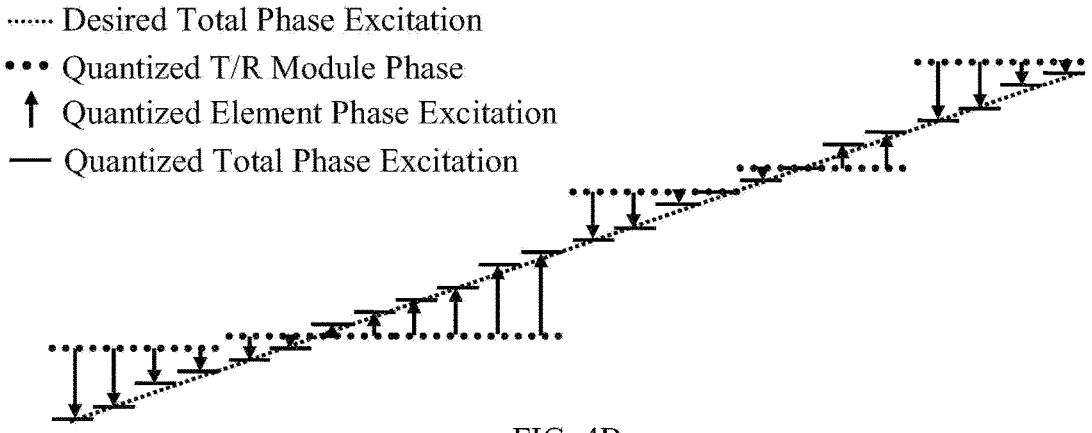
Figure 4C:
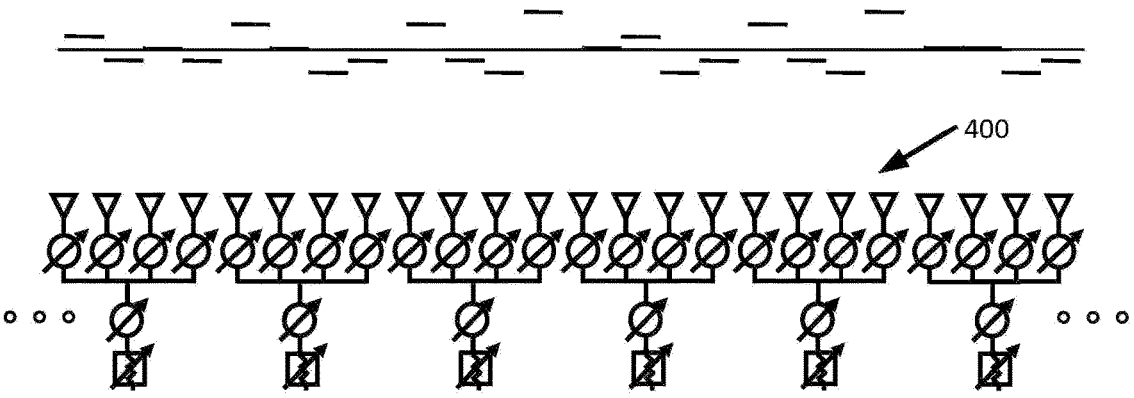

FIGS. 4A-C show an example of the phase addition approach using random phase offsets to break up the periodicity of the phase error. A zero-mean randomly distributed phase offset, shown in FIG. 4A, is added to the T/R module phase shifter settings. The magnitude of this offset is measured by the standard deviation of the random variable used. Because the element level phase shifters are set relative to the T/R module phase, which includes the phase offset, the element level phase shifters correct for this offset to produce an overall phase progression at each radiating element to steer the beam to the given scan location, shown in FIG. 4B. The result of using a random offset is a phase error that is randomly distributed across array 400 as shown in FIG. 4C. The maximum value of this error is half of the element level phase shifter least significant bit because values greater or less than this would be set to the next element level phase shifter setting.

Figure 5A:
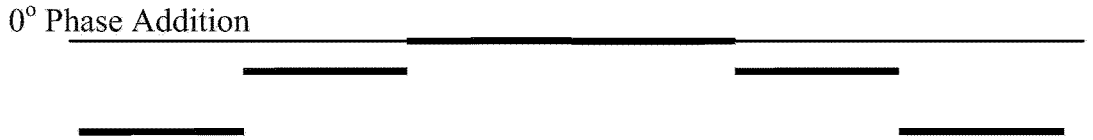
FIG. 5A-C are diagrams adding spherical phase offsets at the beamforming level and correcting for the added offsets at the radiating element level.
Figure 5B:
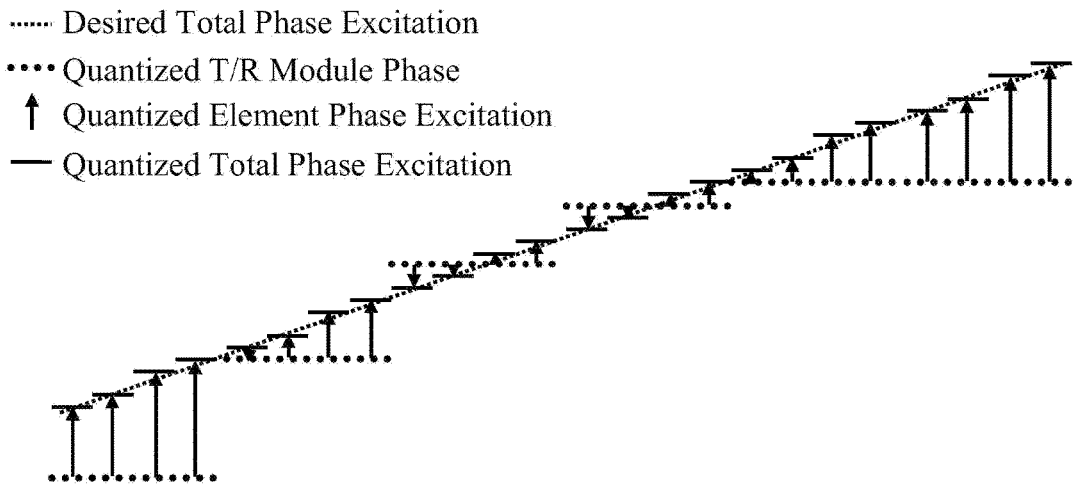
Figure 5C:
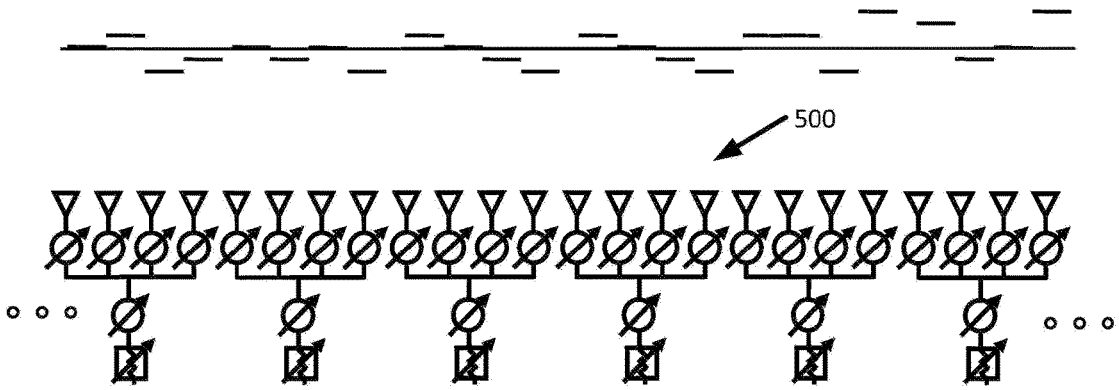

FIGS. 5A-C show an example of the phase addition approach using spherical phase offsets to break up the periodicity of the phase error. A phase offset that is zero at the array center and increases in phase in a spherical shape, shown in FIG. 5A, is subtracted from the T/R module phase shifter settings. The magnitude of the spherical offset is measured by the maximum offset at the edge of the array. Similar to the random phase offset, the element level phase shifters correct for this offset to produce an overall phase progression to steer the beam to the given scan location, shown in FIG. 5B. The result of using a spherical phase offset is a phase error that is non-periodic but still systematic across array 500, as shown in FIG. 5C.

For both random and spherical offsets, the magnitude of the phase offset will have an effect on the resulting peak sidelobes and RMS error level. Since the spherical offset at the array center is zero, and increases away from the center, there will a circular area in the center of the array with approximately a zero phase offset. For the subarrays in this area, there is no change in the phase shifter settings, and the error remains periodic. As the magnitude of the spherical offset increases, this area of approximately zero phase offset becomes smaller and the majority of subarrays have non-periodic error, which can be approximated as randomly distributed. The magnitude of the phase offset is selected to reduce the peak quantization sidelobes to the required level without causing larger than desired increases to the root-mean-square sidelobe level.

The above-described systems and methods can be implemented in digital electronic circuitry, in computer hardware, firmware, and/or software. The implementation can be as a computer program product (i.e., a computer program tangibly embodied in an information carrier medium). The implementation can, for example, be in a machine-readable storage device for execution by, or to control the operation of, data processing apparatus. The implementation can, for example, be a programmable processor, a computer, and/or multiple computers.

In one example, a computer program can be written in any form of programming language, including compiled and/or interpreted languages, and the computer program can be deployed in any form, including as a stand-alone program or as a subroutine, element, and/or other unit suitable for use in a computing environment to carry out the features and functions of various examples discussed herein. A computer program can be deployed to be executed on one computer or on multiple computers at one site.

Method steps or operations can be performed as processes by one or more programmable processors executing a computer program to perform functions of various examples by operating on input data and generating output. Method steps can also be performed by and an apparatus can be implemented as special purpose logic circuitry. The circuitry can, for example, be a field programmable gate array (FPGA) and/or an application specific integrated circuit (ASIC). Modules, subroutines, and software agents can refer to portions of the computer program, the processor, the special circuitry, software, and/or hardware that implements that functionality.

The beamsteering controller 235 may comprise one or more processors suitable for the execution of a computer program include, by way of example, both general and special purpose microprocessors, and any one or more processors of any kind of digital computer. Generally, a processor receives instructions and data from a read-only memory or a random access memory or both. The elements of a computer may comprise a processor for executing instructions and one or more memory devices for storing instructions and data. Generally, a computer can include, can be operatively coupled to receive data from and/or transfer data to one or more mass storage devices (e.g., a memory module) for storing data (e.g., magnetic, magneto-optical disks, or optical disks). The memory may be a tangible non-transitory computer-readable storage medium having computer-readable instructions stored therein for processing RF signals (e.g., radar signals and communication signals), which when executed by one or more processors beamsteering controller 235 cause the one or more processors to carry out or implement the features and functionalities of various examples discussed herein.

Information carriers suitable for embodying computer readable instructions (or programs) and data include all forms of non-volatile memory, including by way of example semiconductor memory devices. The information carriers can, for example, be EPROM, EEPROM, flash memory devices, magnetic disks, internal hard disks, removable disks, magneto-optical disks, CD-ROM, DVD-ROM, and other non-transitory media. The processor and the memory can be supplemented by, and/or incorporated in special purpose logic circuitry.

To provide for interaction with a user, the above described approach can be implemented on a computing device having a display device. The display device can, for example, be a cathode ray tube (CRT) and/or a liquid crystal display (LCD) monitor, and/or a light emitting diode (LED) monitor. The interaction with a user can, for example, be a display of information to the user, and a keyboard and a pointing device (e.g., a mouse or a trackball) by which the user can provide input to the computing device (e.g., interact with a user interface element). Other kinds of devices can be used to provide for interaction with a user. Other devices can, for example, be feedback provided to the user in any form of sensory feedback (e.g., visual feedback, auditory feedback, or tactile feedback). Input from the user can, for example, be received in any form, including acoustic, speech, and/or tactile input.

The above described approach with corresponding systems and procedures can be implemented in a distributed computing system that includes a back-end component. The back-end component can, for example, be a data server, a middleware component, and/or an application server. The above described approach can be implemented in a distributing computing system that includes a front-end component. The front-end component can, for example, be a client computing device having a graphical user interface, a Web browser through which a user can interact with an example implementation, and/or other graphical user interfaces for a transmitting device. The components of an example system can be interconnected by any form or medium of digital data communication (e.g., a communication network). Examples of communication networks include a local area network (LAN), a wide area network (WAN), the Internet, wired networks, and/or wireless networks.

The system may be coupled to and/or include clients and servers. A client and a server are generally remote from each other and typically interact through a communication network. The relationship of client and server arises by virtue of computer programs running on the respective computing devices and having a client-server relationship to each other.

Communication networks may include packet-based networks, which can include, for example, the Internet, a carrier internet protocol (IP) network (e.g., local area network (LAN), wide area network (WAN), campus area network (CAN), metropolitan area network (MAN), home area network (HAN)), a private IP network, an IP private branch exchange (IPBX), a wireless network (e.g., radio access network (RAN), 802.11 network, 802.16 network, general packet radio service (GPRS) network, HiperLAN), and/or other packet-based networks. Circuit-based networks may include, for example, the public switched telephone network (PSTN), a private branch exchange (PBX), a wireless network (e.g., RAN, Bluetooth, code-division multiple access (CDMA) network, time division multiple access (TDMA) network, global system for mobile communications (GSM) network), and/or other circuit-based networks.

"Comprise," "include," and/or plural forms of each are open ended and include the listed parts and can include additional parts that are not listed. "And/or" is open ended and includes one or more of the listed parts and combinations of the listed parts.

Although the above disclosure discusses what is currently considered to be a variety of useful examples, it is to be understood that such detail is solely for that purpose, and that the appended claims are not limited to the disclosed examples, but, on the contrary, are intended to cover modifications and equivalent arrangements that are within the spirit and scope of the appended claims.

One skilled in the art will realize the invention may be embodied in other specific forms without departing from the spirit or essential characteristics thereof. The foregoing examples are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.'

The invention claimed is:

1. A method for reducing sidelobes in a steered beam emitted from a phased array antenna, wherein the phased array antenna includes a plurality of radiating elements, a transmit/receive (T/R) module coupled to a front-end beamformer coupled to a subarray of radiating elements grouped from the plurality of radiating elements, the T/R module including a T/R module phase shifter, and each radiating element associated with an element level phase shifter of the front-end beamformer, the method comprising:

in the phased array antenna:

receiving a radiofrequency signal at the T/R module;

the T/R module phase shifter modifying the received radiofrequency signal by adding a first phase offset and providing the modified radiofrequency signal to the front-end beamformer;

the front-end beamformer splitting the modified radiofrequency signal into a plurality of signal portions and providing each signal portion to a respective element level phase shifter;

each element level phase shifter adding a phase having a bias to each respective signal portion of the plurality of signal portions, wherein an average of the biases being added is the inverse of the first phase offset added to the received radiofrequency signal;

providing a respective phase-shifted signal portion from a respective element level phase shifter to a respective radiating element of the plurality of radiating elements; and each radiating element radiating the provided respective phase-shifted signal portion, wherein the radiated phase-shifted signal portions represent, collectively, the beam steered by the phased array antenna with reduced sidelobes.

2. The method of claim 1 wherein the T/R module phase shifter is a 7-bit phase shifter and each element level phase shifter is a 3-bit phase shifter.

3. The method of claim 1 wherein adding the first phase offset to the radiofrequency signal includes selecting the first phase offset from a random distribution of phase offsets with a mean value of zero.

4. The method of claim 1 wherein adding the first phase offset to the radiofrequency signal includes selecting the first phase offset from a distribution of phase offsets that is spherical in shape and that has a zero phase offset at a center of the distribution and increasing phase offsets towards a periphery of the distribution.

5. The method of claim 4 wherein adding the first phase offset includes applying a zero phase offset at a center of the phased array antenna.

6. The method of claim 4 wherein adding the first phase offset includes applying a maximum phase offset at an edge of the phased array antenna.

7. The method of claim 1 further comprising selecting a magnitude of the first phase offset being added to the radiofrequency signal based on a scan angle location of the phased array antenna.

8. A system for reducing sidelobes in a steered beam emitted from a phased array antenna, the system comprising:

a phased array antenna comprising:

a plurality of radiating elements;

a plurality of element level phase shifters, each communicatively coupled to a respective radiating element;

a front-end beamformer communicatively coupled to the plurality of element level phase shifters, the front-end beamformer configured to receive a modified radiofrequency signal and to split the modified radiofrequency signal into a plurality of signal portions and provide a signal portion to a respective element level phase shifter; and a transmit/receive (T/R) module communicatively coupled to the front-end beamformer to provide the modified radiofrequency signal;

a beamsteering controller communicatively coupled to the phased array antenna, the beamsteering controller configured to:

command the T/R module to:

create the modified radiofrequency signal by adding a first phase offset to a received radiofrequency signal; and command each of the plurality of element level phase shifters to:

add a respective phase having a bias to each signal portion of the plurality of signal portions, wherein an average of the biases being added is the inverse of the first phase offset added to the received radiofrequency signal; and provide a respective phase-shifted signal portion to each radiating element of the plurality of radiating elements, wherein the radiated phase-shifted signal portions represent, collectively, the beam steered by the phased array antenna with reduced sidelobes.

9. The system of claim 8 wherein the T/R module phase shifter is a 7-bit phase shifter and each element level phase shifter is a 3-bit phase shifter.

10. The system of claim 8 wherein the T/R module further includes an attenuator.

11. The system of claim 8 wherein the first phase offset added to the radiofrequency signal is selected from a random distribution of phase offsets with a mean value of zero.

12. The system of claim 8 wherein the first phase offset added to the radiofrequency signal is selected from a distribution of phase offsets that is spherical in shape and has a zero phase offset at a center of the distribution and increasing phase offsets towards a periphery of the distribution.

13. The system of claim 12 wherein a zero phase offset from the distribution is applied at a center of the phased array antenna.

14. A tangible non-transitory computer-readable storage medium having computer readable instructions stored therein for reducing sidelobes in a steered beam emitted from a phased array antenna, wherein the phased array antenna includes a plurality of radiating elements, a transmit/receive (T/R) module coupled to a front-end beamformer coupled to a subarray of radiating elements grouped from the plurality of radiating elements, the T/R module including a T/R module phase shifter, and each radiating element associated with an element level phase shifter, which when executed by a beamsteering controller cause the beamsteering controller to:

command the T/R module to:

modify a received radiofrequency signal by adding a first phase offset;

command the front-end beamformer to:

split the modified radiofrequency signal into a plurality of signal portions; and command each of the plurality of element level phase shifters to:

add a respective phase having a bias to each signal portion of the plurality of signal portions, wherein an average of the biases being added is the inverse of the first phase offset added to the radiofrequency signal; and provide a respective phase-shifted signal portion to each radiating element of the plurality of radiating, elements, wherein the radiated signal portions represent, collectively, the beam steered by the phased array antenna with reduced sidelobes.

* * * * *